US005927771A

United States Patent [19]

Simon et al.

[11] Patent Number: 5,927,771

[45] Date of Patent: Jul. 27, 1999

[54] SINGLE POINT LOCK OPERATOR

[75] Inventors: Clifford Elliott Simon, Mountaintop; Todd Allan Anderson, Conyngham; Edward J. Subliskey; Jeffrey M. Briggs, both of Mountaintop, all of Pa.

[73] Assignee: Allen-Stevens Corp., West Hazelton, Pa.

[21] Appl. No.: 08/876,337

[22] Filed: Jun. 16, 1997

[51] Int. Cl.[6] ..... E05C 3/04

[52] U.S. Cl. ..... 292/241; 292/240; 292/DIG. 47; 292/101

[58] Field of Search ..... 292/101, 336.3, 292/102, 106, 113, 240–242, 217, 109, 226, 200, 114, DIG. 20, DIG. 30, DIG. 47, DIG. 49, DIG. 59, 121, 126, 128, 129

[56] References Cited

U.S. PATENT DOCUMENTS

| | | | |
|---|---|---|---|
| 589,336 | 8/1897 | Carlson . | |
| 917,567 | 4/1909 | Eddy . | |
| 1,102,221 | 6/1914 | Whitford . | |
| 1,152,124 | 8/1915 | Shafer . | |
| 1,269,467 | 6/1918 | Leonard . | |
| 1,351,222 | 8/1920 | Tower . | |
| 2,755,119 | 7/1956 | Abel . | |
| 3,847,423 | 11/1974 | Gley | 292/113 |
| 3,970,213 | 7/1976 | Clay | 292/113 |
| 4,300,794 | 11/1981 | Dunsmoor | 292/247 |
| 4,580,821 | 4/1986 | Genord | 292/336.3 |
| 4,674,777 | 6/1987 | Guelck . | |
| 5,118,145 | 6/1992 | Tucker . | |
| 5,318,333 | 6/1994 | Dreifert | 292/336.3 |
| 5,489,131 | 2/1996 | Blom | 292/101 |
| 5,638,709 | 6/1997 | Clavin | 292/229 |

*Primary Examiner*—Flemming Saether
*Assistant Examiner*—Gary Estremsky
*Attorney, Agent, or Firm*—Hill & Simpson

[57] ABSTRACT

A single point lock or cam lock for a casement window is provided. The lock includes an escutcheon providing a low profile and a smooth uninterrupted surface which faces the inside of the room. The handle includes two opposing legs that enter the escutcheon for attachment to the hook through opposing side walls of the escutcheon. A shaft provides the connection between the hook and the handle which rotates on two brace structures provided by the frame. The frame is sandwiched between the escutcheon and the inside surface of the window frame. The design of the escutcheon, the shaft and the braces of the frame provide for an effective seal against the inside surface of the window frame.

21 Claims, 5 Drawing Sheets

SINGLE POINT LOCK OPERATOR

BACKGROUND OF THE INVENTION

The present invention relates to locks for windows and, more specifically, to a single point lock operator used in conjunction with a keeper to lock a casement window.

An inexpensive means for locking a casement window is provided by a cam lock or a single point lock. Existing cam or single point locks have a locking lever or hook with an elongated body that engages a keeper at one end and a handle at the other end. Upon rotation of the handle from inside the window, the lever rotates and engages the keeper to lock the window. A housing is normally provided which covers the hole in the frame through which the connection between the handle and the lever passes.

One particular problem with single point locks of the above-described type is the inability of these locks to provide an effective seal against the inside surface of the window frame. Specifically, the typical single point lock includes an integrally connected handle/lever which passes through a housing mounted to the inside surface of the frame. Because the construction of the handle and lever must be sturdy, the hole in the housing through which the handle/lever passes is of a substantial size. Accordingly, providing a seal for this large hole is problematic. One solution to this sealing problem is provided in U.S. Pat. No. 4,674,777 which provides a specially designed seal to fit around the rectangularly shaped hole through which the handle/lever passes. The seal provided in the '777 patent is problematic because in addition to being specially designed, it is also difficult to install. Therefore, manufacturing costs are substantial.

Further, after an extended period of use, a certain amount of play may develop between the lock and the keeper when a single point lock is in a closed position. As a result of this loose fit or play, the lock may tend to rattle or vibrate during windy conditions. Further, any looseness in the engagement between the lever and the keeper makes the lock susceptible to being picked by an intruder.

Still further, currently available single-point lock operators suffer from a common design disadvantage in that the escutcheons have a high profile or extend outward from the frame or wall by a substantial difference. In contrast, consumers and designers prefer a low profile operator due to the interference with the curtains, blinds or other window treatments caused by the operators having escutcheons with a higher profile. Accordingly, there is a need for a single point lock operator which provides a low profile escutcheon/handle combination that does not interfere with the operation of the window treatments.

Accordingly, there is a need for an improved cam lock or single point lock design for casement windows which provides a solution to the aforenoted problems.

SUMMARY OF THE INVENTION

The present invention provides an improved single point lock for casement windows that solves the aforenoted problems presented by currently available single point locks. In accordance with the present invention, a single point lock is provided which includes a base member that consists of a frame that defines a centrally disposed slot. The frame further includes a pair of braces disposed on opposing sides of the slot. The braces support a shaft which connects a hook to a handle. The hook engages a lock member or keeper when the lock is in a locked or closed position. The handle is disposed on the inside surface of the frame. Rotation of the handle from the open to the closed position results in rotation of the hook from the open to the closed position. A smooth rotational movement is provided by the engagement between the shaft and the braces.

In an embodiment, the base member further includes a pair of brackets which connect the base member to a housing. The housing provides a suitable cover for the base member. The handle consists of a pair of opposing legs each having a distal end that is connected to the shaft and each having a proximate end that is connected to a grip member. In operation, the user grasps the grip member and rotates the handle from the open to the closed position and vice versa.

In an embodiment, the hook, handle and shaft are unitary in construction and are preferably cast from a single mold.

In an embodiment, the hook and handle are separate parts and are connected together at the shaft, which includes a first semi-circular portion attached to the handle and a second semi-circular portion attached to the hook. A pin fixedly connects the two shaft portions together. The proximate end of the hook may further comprise an arm that extends around the portion of the shaft that is attached to the handle. In an embodiment where a pin is used to connect the two shaft portions together, the pin may extend through the arm portion of the hook.

In an embodiment, a spring is disposed underneath the housing which biases the hook and handle into either an open position or a closed position. As the hook and handle are moved toward an open position, a biasing force exerted by the spring urges the hook and handle toward the open position. In contrast, as the hook and handle are moved toward the closed or locked position, the spring exerts a biasing force which urges the hook and handle toward the closed or locked position.

In an embodiment, the grip portion of the handle is disposed substantially parallel to the base and just beyond the housing when the lock is in a closed position.

It is therefore an object of the present invention to provide an improved single point lock operator for casement windows which provides an improved design having a low profile escutcheon that provides an effective cover for the hole in the frame through which the hook or lever portion of the lock passes.

Another object of the present invention is to provide an improved single point lock operator which features a handle that is disposed against the inside surface of the window frame, or parallel to the base portion of the lock, when the lock is in a closed position.

Another object of the present invention is to provide an improved single point lock operator construction which does not require a seal for the exposed portion of the escutcheon.

Yet another object of the present invention is to provide an improved single point lock operator that can be sealed against the inside surface of the window frame.

Still another object of the present invention is to provide an improved single point lock operator having an improved handle/hook combination that is unitary in construction and that can be cast from a single mold.

Other objects and advantages of the present invention will become apparent upon reading the following detailed description and appended claims, and upon reference to the accompanying drawings.

BRIEF DESCRIPTION OF THE DRAWINGS

For a more complete understanding of the present invention, reference should now be made to the embodiments illustrated in greater detail and the accompanying drawings and described below by way of an example of the present invention.

In the drawings:

FIG. is an exploded view of a single point lock operator made in accordance with the present invention.

Figure 2:
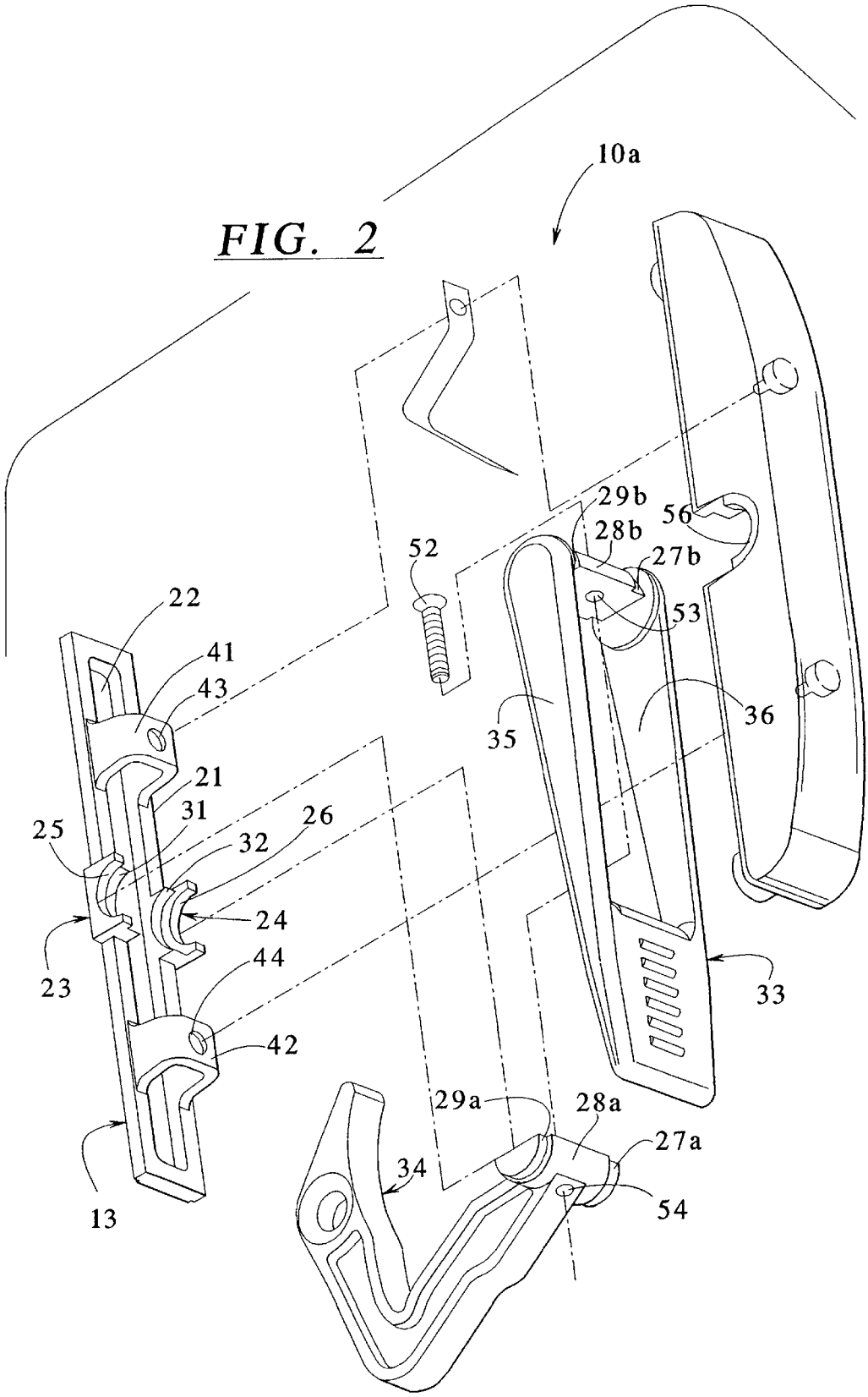

FIG. 2 is an exploded view of another embodiment of a single point lock operator made in accordance with the present invention.

Figure 3:
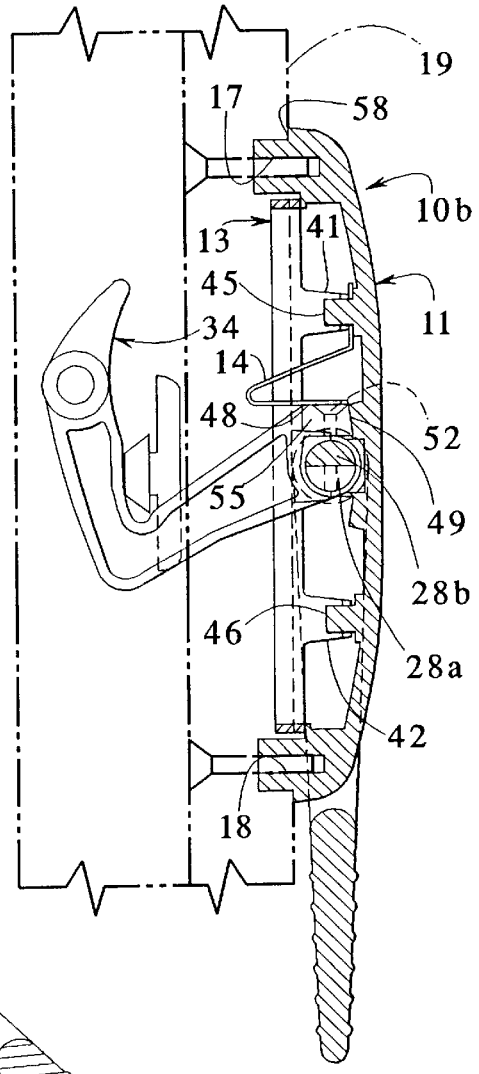

FIG. 3 is a side sectional view of the single point lock operator first shown in FIG. 2 in the closed or locked position.

Figure 4:
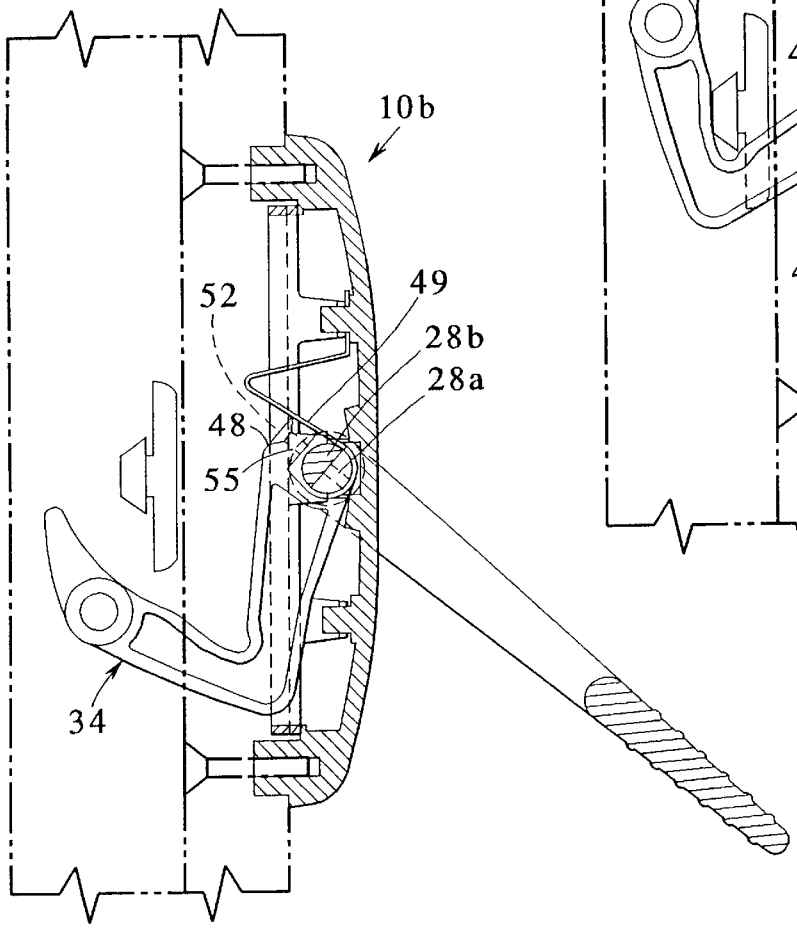

FIG. 4 is a side sectional view of the single point lock operator shown in FIG. 2 in an open or unlocked position.

Figure 1:
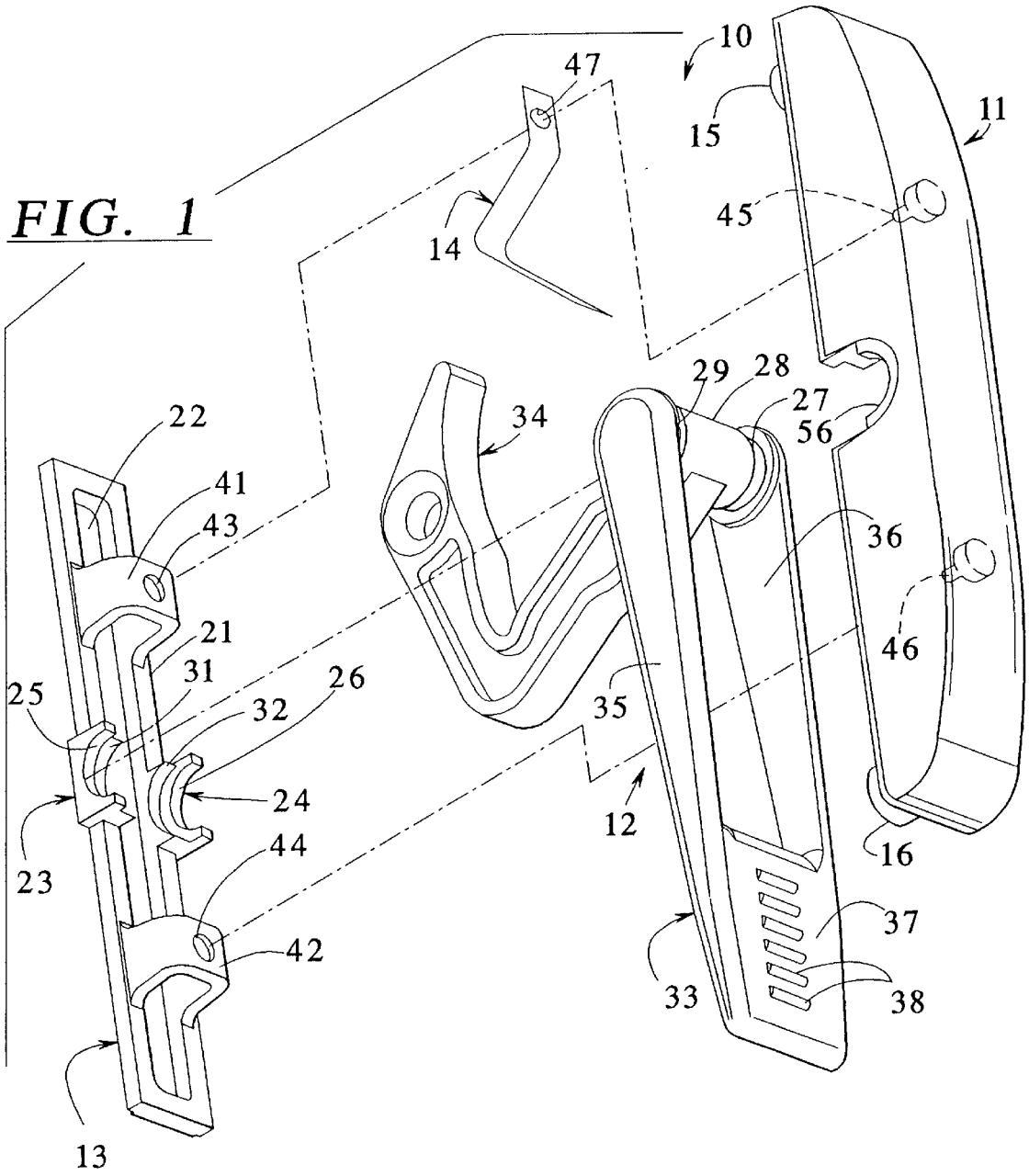
Figure 7:
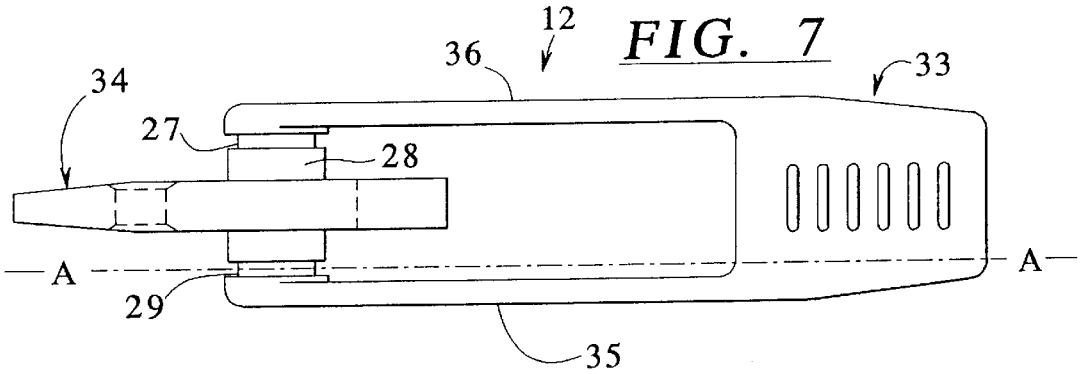
Figure 5:
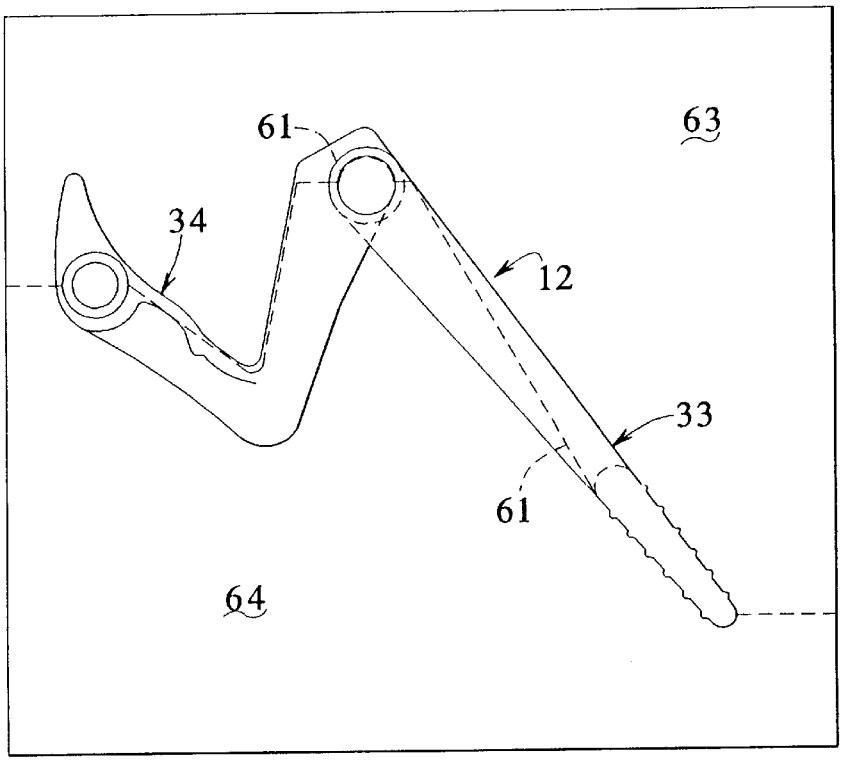

FIG. 5 is a side elevational view of the handle/shaft/hook of the single point lock operator first shown in FIG. 1, particularly illustrating the parting line for the cover half of the die and the ejector half of the die as illustrated by the line A—A shown in FIG. 7.

Figure 6:
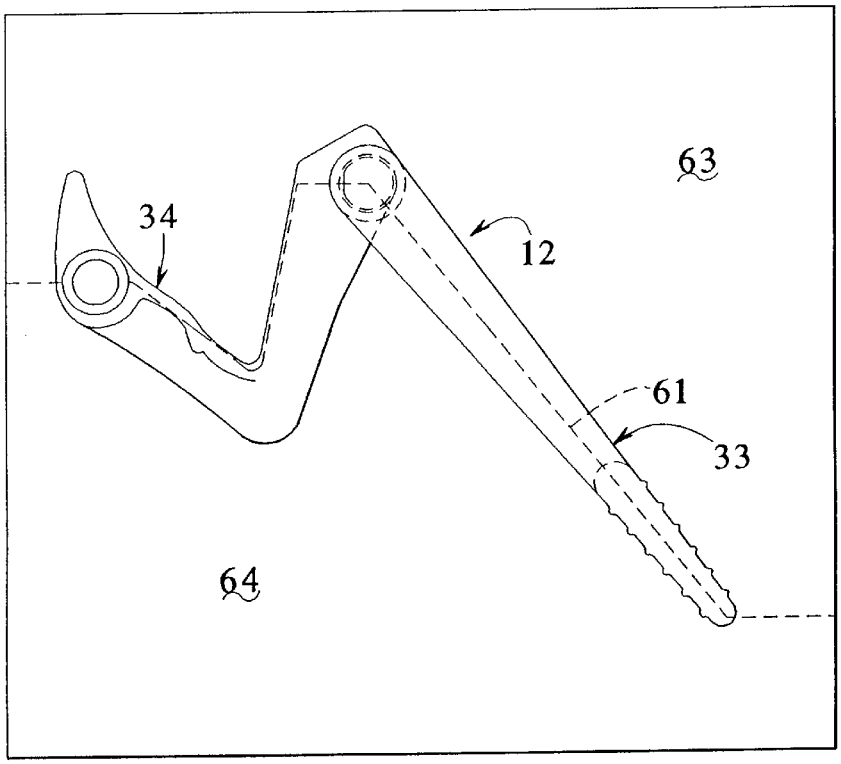

FIG. 6 is a side elevational view of the handle/shaft/hook first shown in FIG. 1, particularly illustrating the parting line for the cover half and ejector half of the die which is disposed outside of the part.

FIG. 7 is a top plan view of the handle/shaft/hook first shown in FIG. 1.

Figure 8:
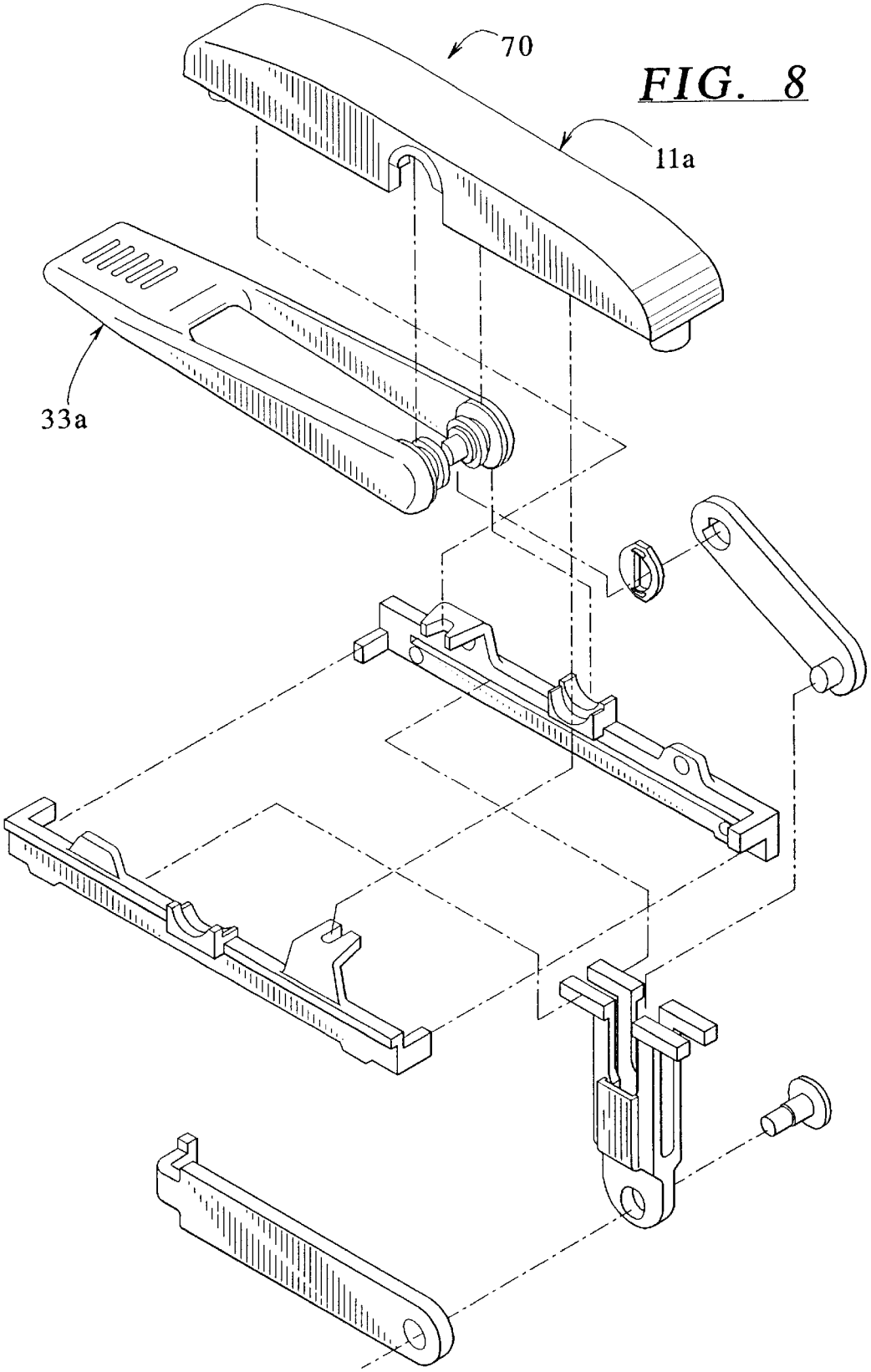

FIG. 8 is an exploded view of a multi-point lock operator which incorporates the escutcheon and handle design of the single point lock operator of the present invention thereby enabling the single point lock operator and multi-point lock operators to have the same appearance from the inside of the building or room.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Turning first to FIG. 1, one embodiment of the lock system 10 of the present invention is illustrated. The system 10 includes an escutcheon 11, a unitary handle/shaft/hook combination 12, a base 13 and a spring 14. The base 13 is sandwiched against the inside surface of a window frame (not shown) by the escutcheon 11. Specifically, the supports 15, 16 disposed at opposing ends of the escutcheon 11 include centrally disposed threaded holes 17, 18 respectively (see FIG. 3). Screws or bolts that extend upward through the inside surface of the frame are received in the threaded holes 17, 18 and fasten the escutcheon 11 against the frame surface 19 (see FIG. 3) thereby trapping the base 13 between the escutcheon 11 and frame surface 19.

Returning to FIG. 1, the base 13 includes an elongated frame 21 which defines a central slot 22. Opposing sides of the frame 21 include braces 23, 24. The braces 23, 24 include curved outer receiving areas 25, 26 for receiving and supporting outer recessed portions 29, 27 respectively of the shaft 28. The inner receiving areas 31, 32 receive and support non-recessed portions of the shaft 28. The braces 23, 24 enable the shaft 28, and therefore the handle 33 and hook 34, to rotate between an open or unlocked position as shown in FIG. 4 and the closed or locked position as shown in FIG. 3.

Still referring to FIG. 1, the shaft 28 connects the handle 33 of the handle/shafthook combination structure 12 to the hook 34. The handle 33 features two opposing legs 35, 36 which are attached to opposing ends of the shaft 28 adjacent to the outer recessed portions or grooves 29, 27 of the shaft 28. The opposing legs 35, 36 of the handle 33 are also joined at their distal ends by a grip 37 which may feature a plurality of upwardly protruding grip structures shown at 38.

The base 13 also includes two upwardly protruding brackets 41, 42 which include centrally disposed holes 43, 44 for receiving the pins 45, 46 attached to the underside of the escutcheon 11 (see also FIG. 3).

A spring 14 is also disposed underneath the escutcheon 11 and is held in place by the reception of the pin 45 into the hole 47 disposed at one end of the spring 14. The spring 14 can bias the hook into a closed position as shown in FIG. 3 by engaging the surface 48 disposed at the front of the juncture of the hook 34 and shaft 28 (see also FIG. 4). The spring 14 also biases the hook 34 into an open or unlocked position as shown in FIG. 4 by engaging the surface 49 disposed at the top of the juncture of the hook 34 and the shaft 28 (see also FIG. 3).

An alternative embodiment of the structure of the hook 34 and handle 33 is shown in FIG. 2. Specifically, in contrast to the solid shaft 28 shown in FIG. 1 which fixedly connects the hook 34 and handle 33 as a single, unitary structure, in FIG. 2, the shaft is split into two half portions 28*a* and 28*b*. These two half portions 28*a* and 28*b* are connected by a pin or screw 52 that passes through the hole 53 in the shaft portion 28*b* and the hole 54 in the shaft portion 28*a*. The screw 52 is also shown in FIGS. 3 and 4. Also shown in FIGS. 3 and 4 is the employment of an arm structure 55 attached to a proximate end of the hook 34 which wraps around and receives the shaft portion 28*b* of the handle 33. If the embodiment illustrated in FIG. 2 is employed, the flat areas 48 and 49 for engaging the spring 14 should be disposed on the shaft portion 28*b* of the handle 33.

Thus, in FIGS. 1–4, three embodiments of the handle 33, shaft 28 and hook 34 are illustrated. A unitary structure 12 is illustrated in FIG. 1 whereby the hook 34 and handle 33 are attached to one another by the shaft 28. In FIG. 2, a two-piece structure is illustrated whereby the shaft is split into two halves 28*a* and 28*b* with the first half 28*a* attached to a proximate end of the hook 34 and the other half 28*b* being attached to proximate ends of the opposing legs 35, 36 of the handle 33. Finally, a variation of the embodiment illustrated in FIG. 2, an arm structure 55 may be attached to the proximate end of the hook 34 which extends around the shaft portion 28*b* thereby providing a receiving pocket for the shaft portion 28*b*. In all three variations, surfaces such as 48 and 49 are preferably included for engaging the spring 14 which, as discussed above, can bias the hook 34 into either a locked or closed position as shown in FIG. 3 or an unlocked or open position as shown in FIG. 4.

As shown in FIGS. 3 and 4, the lock operators shown at 10 (FIG. 1), 10*a* (FIG. 2) and 10*b* (FIGS. 3 and 4) provide an effective seal against the inside frame surface 19. The escutcheon 11 includes an outer rim 58 which provides a sealing engagement against the frame surface 19. The rim 58 may also be equipped with a gasket to further enhance the seal between the rim 58 and the surface 19. The base 13 fits into a recessed hole disposed in the frame surface 19. Engagement between the rim 58 of the escutcheon 11 and the frame surface 19 surrounds the base 13 except for the two apertures disposed in the sides of the escutcheon which accommodate the proximate ends of the opposing legs 35, 36 of the handle 33. However, the combination of the engagement between the outer grooves 29, 27 of the shaft 28 (see FIG. 1) or the outer groove portion 29*a*, 29*b* and 27*a* and 27*b* (see FIG. 2) with the outer receiving areas 25, 26 of the base 13 and the engagement between the shaft 28 or shaft portions 28*a*, 28*b* with the inner receiving areas 31, 32 of the base 13 provides an effective seal and substantially prevents air flow through the frame surface 19 into the room. Additional sealing is provided by the downwardly extending curved ledge shown at 56 of the escutcheon 11 which, as illustrated in FIG. 1, engages the outer groove 29 or, as illustrated in FIG. 2, engages the outer groove portions 29*a* and 29*b*. Hence, the operator of the present invention provides a suitable seal against the inside surface 19 of the window sash without the need for washers or additional gaskets.

Another advantage of the present invention is illustrated in FIG. 3. Specifically, the lock 10 has a very low profile while in the closed or locked position. The low profile provides for a more attractive appearance from the inside of the window and makes the lock 10 less noticeable, and therefore more attractive, to the consumer.

The unitary structure 12 of the handle 33/shaft 28/hook 34 is further illustrated in FIGS. 5–7. Specifically, this structure 12 may be cast from a single mold. A first parting line 61 is illustrated and is also shown at line A—A in FIG. 7. A second parting line 62 is shown in FIG. 6 which is disposed outside of the structure 12. The cover half of the die is indicated generally at 63 in both FIGS. 5 and 6 and the ejector half of the die is shown generally at 64 in both FIGS. 5 and 6.

Turning to FIG. 8, an exploded view of a multi-point lock operator 70 which includes an escutcheon 11*a* and a handle 33*a* which provides the same aesthetic appearance from the inside of the building or room as the operators 10, 10*a* and 10*b* shown above in FIGS. 1–4. Hence, a multi-point operator 70 and a single-point operator 10, 10*a* or 10*b* may be used in the same room or alongside one another due to the same shape and profile of the escutcheons and exposed portions of the handles. It will further be noted that the escutcheon 11 and handle portion 33 of the operators of the present invention provide the low profile desired by consumers and designers. An example of the profile presented by both the single-point operators 10, 10*a* and 10*b* as well as the profile presented by the multi-point operator 70 is provided in co-pending design patent application Ser. No. 29/065,244, which is incorporated herein by reference.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A sash lock for locking a window sash against a window frame, the window frame including a lock member disposed therein for engaging the sash lock, the sash lock comprising:

a base member comprising an elongated frame having an upper side and a lower side, the frame defining a central slot that extends through the frame, the upper side of the frame comprising a pair of braces disposed on opposing sides of the slot, the braces supporting a shaft that connects a hook to a handle, the shaft extending across the slot and being supported by the pair of braces with the hook extending from the braces and through the slot, the hook comprising a distal end disposed below the lower side of the frame, the distal end for engaging the lock member of the window frame and a proximate end connected to the shaft, the handle comprising a pair of opposing legs having distal ends that are connected by the shaft and proximate ends that are connected by a grip, the base member being disposed between the opposing legs of the handle, whereby rotation of the handle between an open position and a closed position, that is about 180 degrees relative to the open position results in rotation of the hook between the open and closed positions, the base member being disposed between and coplanar with both the grip and the shaft in both the open and closed positions and wherein the hook, handle and shaft are connected to preclude relative movement with respect to each other in operation of the assembled sash lock.

2. The lock of claim 1 wherein the base member further comprises a pair of brackets disposed adjacent to opposing ends of the slot, and the lock further comprises an escutcheon that is connected to the brackets, the escutcheon being disposed between the opposing legs of the handle.

3. The lock of claim 1 wherein the distal end of the hook is disposed below the base member and the grip is disposed above the base.

4. The lock of claim 1 wherein the hook, handle and shaft are unitary in construction.

5. The lock of claim 1 wherein the shaft further comprises a first and a second abutting halves, the first abutting half being connected to the proximate end of the hook and the second abutting half being connected to the opposing legs of the handle.

6. The lock of claim 5 wherein the proximate end of the hook further comprises an arm that extends underneath the second abutting half.

7. The lock of claim 6 further comprising a pin that extends through the arm of the hook into the second abutting half thereby connecting the hook to the handle.

8. The lock of claim 7 wherein the pin extends through the second abutting half into the first abutting half.

9. The lock of claim 1 further comprising a spring that biases the hook into the closed position.

10. The lock of claim 1 further comprising a spring that biases the hook into the open position.

11. The lock of claim 1 further comprising a spring that biases the hook into the closed position when the hook is in or close to the closed position, the spring biasing the hook into the open position when the hook is in or close to the open position.

12. The lock of claim 1 wherein the grip comprises a flat member that is disposed substantially parallel to the base when the lock is in a closed position.

13. The lock of claim 12 wherein the flat member of the grip further comprises a plurality of protruding members.

14. The lock of claim 1 further comprising a spring that biases the hook into both the open position or the closed position.

15. A sash lock comprising:

a base member comprising an upper side, a lower side and a centrally disposed slot through which a hook extends, the upper side of the base further comprising a brace for supporting the hook and a handle and a bracket for connecting an escutcheon above the frame, a shaft for providing an axis about which the hook and handle rotate from an open position to a closed position about 180 degrees relative to the open position, the shaft comprising a circular cylinder that is axially split into two portions, the hook comprising a distal locking end disposed below the lower side of the base member and a proximate end intergrally formed with and connected to one of the shaft portions that is disposed above the upper side of the base member and which is supported by the brace, the handle comprising a distal end integrally formed with and connected to the other of the shaft portions and whereby the shaft portions are supported by the brace such that the hook, handle and shaft portions are connected to preclude relative movement with respect to each other in operation of the assembled sash lock and a proximate end connected to a grip, the handle pivoting around the escutcheon so that the escutcheon being disposed between and coplanar with the shaft and the grip when the handle is in both an open position and a closed position.

16. The lock of claim 15 wherein the base further comprises a pair of braces disposed on opposing sides of the slot, the shaft extending across and being supported by said pair of braces.

17. The lock of claim 15 wherein the two abutting halves of the shaft are connected by a pin extending through both halves.

18. The lock of claim 15 further comprising a spring that biases the lock into a closed position when the lock is in the closed position or near the closed position, the spring further biasing the lock into an open position when the lock is in the open position or near the open position.

19. The lock of claim 15 wherein the proximate end of the hook comprises an arm that extends underneath and around the half of the shaft that is connected to the handle.

20. The lock of claim 15 wherein the hook, handle and shaft are unitary in construction.

21. A sash lock for locking a window sash against a window frame, the window frame including a lock member disposed therein for engaging the sash lock, the sash lock comprising:

a base member comprising an elongated frame having an upper side and a lower side, the frame defining a central slot, the upper side of the frame comprising a pair of braces disposed on opposing sides of the slot, the upper side of the frame further comprises a pair of brackets disposed adjacent to opposing ends of the slot, the lock further comprises an escutcheon that is connected to the brackets above the frame and a spring disposed between one of said brackets and the shaft, the braces supporting a shaft that connects a hook to a handle, the shaft extending transversely across the slot and being supported above the slot by the pair of braces with the hook extending through the slot, the hook, handle and shaft being unitary in construction, the hook comprising a distal end disposed below the frame, the distal end of the hook engaging the lock member of the window sash, the hook further comprising a proximate end connected to the shaft, the handle comprising a pair of opposing legs having distal ends that are connected by the shaft and proximate ends that are connected by a grip, the escutcheon being disposed between the opposing legs of the handle, the shaft passing through opposing sides of the escutcheon before being connected to the opposing legs of the handle and wherein the hook, handle and shaft are connected to preclude relative movement with respect to each other in operation of the assembled sash lock, the spring biasing the hook and handle into a closed position when the hook and handle are in or close to the closed position, the spring biasing the hook and handle into an open position when the hook is in or close to the open position, the escutcheon having two opposing ends, one of the opposing ends of the escutcheon being disposed between and coplanar with both the grip and the shaft when the handle is in the closed position that is about 180 degrees relative to the open position, the other opposing end of the escutcheon being disposed between and coplanar with both the grip and the shaft when the handle is in the open position.

* * * * *